US008840968B2

(12) United States Patent
Renshaw et al.

(10) Patent No.: US 8,840,968 B2
(45) Date of Patent: Sep. 23, 2014

(54) METHOD OF CONTROLLING SURFACE DEFECTS IN METAL-COATED STRIP

(75) Inventors: Wayne Renshaw, Unanderra (AU); Qiyang Liu, Mount Keira (AU)

(73) Assignee: Bluescope Steel Limited, Melbourne, Victoria (AU)

( * ) Notice: Subject to any disclaimer, the term of this patent is extended or adjusted under 35 U.S.C. 154(b) by 0 days.

(21) Appl. No.: 13/182,704

(22) Filed: Jul. 14, 2011

(65) Prior Publication Data

US 2011/0268984 A1 Nov. 3, 2011

Related U.S. Application Data

(63) Continuation of application No. 11/231,374, filed on Sep. 20, 2005, now abandoned, which is a continuation of application No. PCT/AU2004/000345, filed on Mar. 19, 2004.

(30) Foreign Application Priority Data

Mar. 20, 2003 (AU) ..... 2003901424

(51) Int. Cl.

| | |
|---|---|
| ***C23C 2/04*** | (2006.01) |
| ***C23C 2/06*** | (2006.01) |
| ***C23C 2/12*** | (2006.01) |
| ***C23C 2/40*** | (2006.01) |
| ***B05D 1/18*** | (2006.01) |
| ***C23C 2/02*** | (2006.01) |

(52) U.S. Cl.

CPC ... *C23C 2/02* (2013.01); *C23C 2/06* (2013.01); *C23C 2/04* (2013.01); *B05D 1/18* (2013.01); *C23C 2/12* (2013.01); *C23C 2/40* (2013.01)

USPC ..... 427/436; 427/321; 427/434.2

(58) Field of Classification Search

CPC ..... B05D 1/18; C23C 2/02; C23C 2/04; C23C 2/06; C23C 2/12; C23C 2/40

USPC ..... 427/434.2, 436

See application file for complete search history.

(56) References Cited

U.S. PATENT DOCUMENTS

| | | | | |
|---|---|---|---|---|
| 3,782,909 | A | 1/1974 | Cleary et al. | |
| 3,806,356 | A | 4/1974 | Shoemaker | |
| 3,860,438 | A | 1/1975 | Shoemaker | |
| 3,952,120 | A | 4/1976 | Horton et al. | |
| 4,053,663 | A | 10/1977 | Caldwell et al. | |
| 4,264,684 | A | 4/1981 | Allegra et al. | |
| 4,287,008 | A | 9/1981 | Torok et al. | |
| 4,310,572 | A | 1/1982 | Stavros | |
| 4,350,539 | A | 9/1982 | Torok et al. | |
| 4,350,540 | A | 9/1982 | Allegra et al. | |
| 4,421,054 | A | 12/1983 | Stavros | |
| 4,456,663 | A | 6/1984 | Leonard | |
| 4,557,953 | A | 12/1985 | Boston et al. | |
| 5,091,150 | A * | 2/1992 | Memmi et al. | 420/541 |
| 5,217,759 | A | 6/1993 | Lamberigts et al. | |
| 5,853,806 | A * | 12/1998 | Higuchi et al. | 427/310 |
| 6,093,452 | A | 7/2000 | Ishii et al. | |
| 6,652,990 | B2 * | 11/2003 | Carey et al. | 428/647 |
| 2006/0177687 | A1 | 8/2006 | Renshaw et al. | |

FOREIGN PATENT DOCUMENTS

| | | | |
|---|---|---|---|
| AU | 200143836 | | 9/2002 |
| AU | 2003901424 | * | 3/2003 |
| EP | 0483810 | | 6/1992 |
| JP | 06299310 | | 10/1994 |
| JP | 9003552 | | 1/1997 |
| JP | 11286762 | | 10/1999 |
| JP | 2001-316791 A | * | 11/2001 |
| JP | 2001316791 | | 11/2001 |
| JP | 2002-241917 A | * | 8/2002 |
| JP | 2002241917 | | 8/2002 |
| WO | 0127343 | | 4/2001 |
| WO | 2004065039 | | 8/2004 |
| WO | 2004083466 | | 9/2004 |
| WO | 2004083480 | | 9/2004 |
| WO | 2005052209 | | 6/2005 |

OTHER PUBLICATIONS

Definition of "Standard Deviation" from www.wikipedia.com.*

Australian Patent Office application details for AU 2003901424, retrieved May 7, 2014, 2 pages.*

Definition of "Standard Deviation" from www.wikipedia.com; retrieved Jul. 14, 2009, 14 pages.*

Translation—English translation of JP 2001-316791, Maki et al., Nov. 30, 2009.

Translation—English translation of JP 2002-241917, Sep. 15, 2005.

Translation—English translation of JP 06-299310 abstract, Sep. 15, 2005.

Translation—English translation of JP 9003552 abstract, Sep. 15, 2005.

Translation—English translation of JP 11286762 abstract, Sep. 15, 2005.

* cited by examiner

*Primary Examiner* — William Phillip Fletcher, III

(74) *Attorney, Agent, or Firm* — Hahn Loeser & Parks, LLP; Arland T. Stein

(57) ABSTRACT

A method of controlling "rough coating" and "pinhole-uncoated" surface defects on a steel strip coated with a aluminum-zinc-silicon alloy. The alloy has 50-60% wt Al, 37-46% wt Zn and 1.2-2.3% wt Si. The method includes heat treating the steel strip in a heat treatment furnace and thereafter hot-dip coating the strip in a molten bath and thereby forming a coating of the alloy on the steel strip. The method is characterized by controlling the concentration of (i) strontium or (ii) calcium or (iii) strontium and calcium in the molten bath to be at least 2 ppm.

5 Claims, 3 Drawing Sheets

METHOD OF CONTROLLING SURFACE DEFECTS IN METAL-COATED STRIP

CROSS-REFERENCE TO RELATED APPLICATIONS

Figure 1:
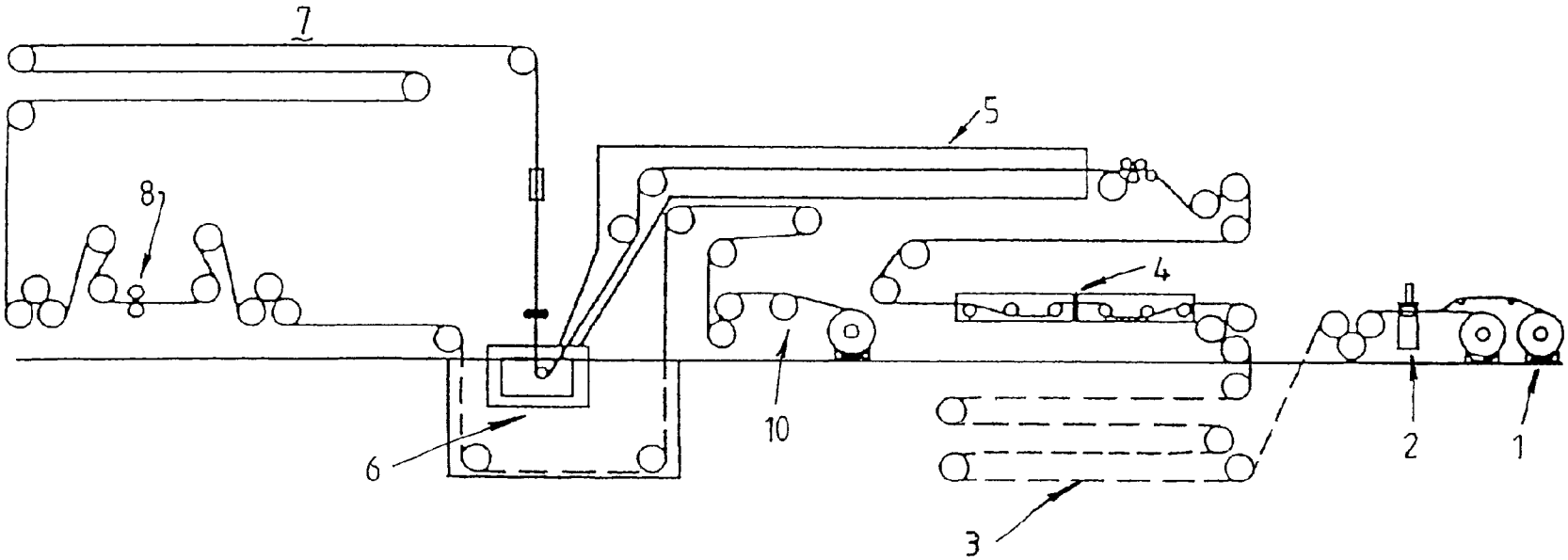

This application is a continuation of U.S. application Ser. No. 11/231,374, filed Sep. 20, 2005, now abandoned, which is a continuation of International Application No. PCT/AU2004/000345, filed Mar. 19, 2004, which claims priority from Application No. AU 2003901424, filed Mar. 20, 2003. The disclosure of which are all hereby incorporated by reference in their entirety.

BACKGROUND OF THE INVENTION

The present invention relates to controlling surface defects, as described hereinafter, in steel strip that has a corrosion-resistant metal coating that is formed on the strip by hot-dip coating the strip in a molten bath of coating metal.

The present invention relates particularly but not exclusively to metal coated steel strip that can be cold formed (e.g., by roll forming) into an end-use product, such as roofing products.

The present invention relates particularly but not exclusively to metal coated steel strip having an aluminum-zinc-silicon alloy coating that can be cold formed (e.g., by roll forming) into an end-use product, such as roofing products. The applicant is interested particularly in aluminum-zinc-silicon alloy coated steel strip that is sold in Australia under the registered trade mark Zincalume and in other countries under the registered trade mark Galvalume.

The present invention also relates particularly but not exclusively to metal coated steel strip having an aluminum-zinc-silicon alloy coating with small spangle size, i.e., a coating with an average spangle size of the order of less than 0.5 mm. Coated steel strip products with larger spangle size do not tend to show the generally small defects because the defects are camouflaged by the appearance of the spangle pattern.

The term "aluminum-zinc-silicon alloy" is understood herein to mean alloys comprising the following ranges in weight percent of the elements aluminum, zinc and silicon:

Aluminum: 50-60

Zinc: 37-46

Silicon: 1.2-2.3

The term "aluminum-zinc-silicon" alloy is also understood herein to mean alloys that may or may not contain other elements, such as, by way of example, any one or more of iron, vanadium, chromium, and magnesium.

In the conventional hot-dip metal coating method, steel strip generally passes through one or more heat treatment furnaces and thereafter into and through a bath of molten coating metal, such as aluminum-zinc-silicon alloy, held in a coating pot. The furnaces may be arranged so that the strip travels horizontally through the furnaces. The furnaces may also be arranged so that the strip travels vertically through the furnaces and passes around a series of upper and lower guide rollers. The coating metal is usually maintained molten in the coating pot by the use of heating inductors. The strip usually exits the heat treatment furnaces via an outlet end section in the form of an elongated furnace exit chute or snout that dips into the bath. Within the bath, the strip passes around one or more sink rolls and is taken upwardly out of the bath. After leaving the coating bath, the strip passes through a coating thickness control station, such as a gas knife or gas wiping station, at which its coated surfaces are subjected to jets of wiping gas to control the thickness of the coating. The coated strip then passes through a cooling section and is subjected to forced cooling. The cooled strip may thereafter be optionally conditioned by passing the coated strip successively through a skin pass rolling section (also known as a temper rolling section) and a tension leveling section. The conditioned strip is coiled at a coiling station.

The present invention is concerned particularly but not exclusively with minimizing the presence of particular surface defects on steel strip that has been hot dip coated with an aluminum-zinc-silicon alloy.

The particular surface defects are described by the applicant as "rough coating" and "pinhole-uncoated" defects. Typically, a "rough coating" defect is a region that has a substantial variation in coating over a 1 mm length of strip, with the thickness varying between 10 micron thick and 40 micron thick. Typically, a "pinhole-uncoated" defect is a very small region (<0.5 mm in diameter) that is coated.

SUMMARY OF THE INVENTION

In general terms, the present invention provides a method of controlling surface defects of the type described above on a steel strip coated with an alloy that includes the steps of: successively passing the steel strip through a heat treatment furnace and a bath of molten alloy, and:

(a.) heat treating the steel strip in the heat treatment furnace; and (b) hot-dip coating the strip in the molten bath and thereby forming a coating of the alloy on the steel strip; and which method is characterized by controlling the concentration of (i) strontium or (ii) calcium or (iii) strontium and calcium in the molten bath to be at least 2 ppm.

More preferably, the molten bath contains an aluminum-zinc-silicon alloy.

The above-described method is characterized by the deliberate inclusion of the elements strontium and/or calcium in the coating aluminum-zinc-silicon alloy. In the context of the present invention, the elements are regarded as beneficial.

The aluminum-zinc-silicon alloy may include other elements.

However, preferably the aluminum-zinc-silicon alloy does not contain the elements vanadium and/or chromium as deliberate alloy elements—as opposed to being present in trace amounts or impurities, for example, due to contamination in the molten bath.

In a situation in which the molten bath contains strontium and no calcium, preferably the method includes controlling the concentration of strontium in the molten bath to be in the range of 2-4 ppm.

More preferably the strontium concentration is about 3 ppm.

In a situation in which the molten bath contains calcium and no strontium, preferably the method includes controlling the concentration of calcium in the molten bath to be in the range of 4-8 ppm.

More preferably the calcium concentration is about 6 ppm.

In a situation in which the molten bath contains strontium and calcium, preferably the method includes controlling the concentration of strontium and calcium in the molten bath to be at least 4 ppm.

Preferably the method includes controlling the concentration of strontium and calcium in the molten bath to be in the range of 2-12 ppm.

Preferably the method includes controlling the concentration of (i) strontium or (ii) calcium or (iii) strontium and calcium in the molten bath to be at no more than 150 ppm.

More preferably method includes controlling the concentration of (i) strontium or (ii) calcium or (iii) strontium and calcium in the molten bath to be no more than 50 ppm.

The applicant has found that the control of strontium and calcium concentrations in the molten bath has a particularly beneficial effect on aluminum-zinc-silicon alloys that contain magnesium.

Preferably aluminum-zinc-silicon alloys have a magnesium concentration of less than 1%.

More preferably aluminum-zinc-silicon alloys have a magnesium concentration of less than 50 ppm.

The concentration of (i) strontium or (ii) calcium or (iii) strontium and calcium in the molten bath may be controlled by any suitable means.

In a further aspect of the present invention, this is accomplished by providing a metal coated steel strip comprising: a steel strip; and an aluminum-zinc-silicon hot-dip coating on the steel strip comprising a concentration of at least 2 ppm of at least one of strontium and calcium.

Another, although not the only other, option is to periodically dose the molten bath with amounts of strontium and/or calcium that are required to maintain the concentration(s) at a required concentration.

The present invention is also particularly advantageous for steel strip that does not have a surface appearance, such as spangled strip, that obscures the surface defects and has not been conditioned by heavily skin pass rolling the strip to obscure the surface defects. An example of such a non-heavy skin passed rolled strip is steel strip that is conditioned to have a residual stress of no more than 100 MPa in the strip—as described by way of example in Australian complete application 43836/01 in the name of the applicant. The disclosure in the Australian complete application is incorporated herein by cross-reference.

The furnace may be any suitable furnace, such as a horizontal furnace or a vertical furnace.

Preferably the furnace has an elongated furnace exit chute or snout that extends into the bath.

According to the present invention there is also provided a steel strip coated with an alloy produced by the above-described methods.

BRIEF DESCRIPTION OF THE DRAWING FIGURES

Figure 2:
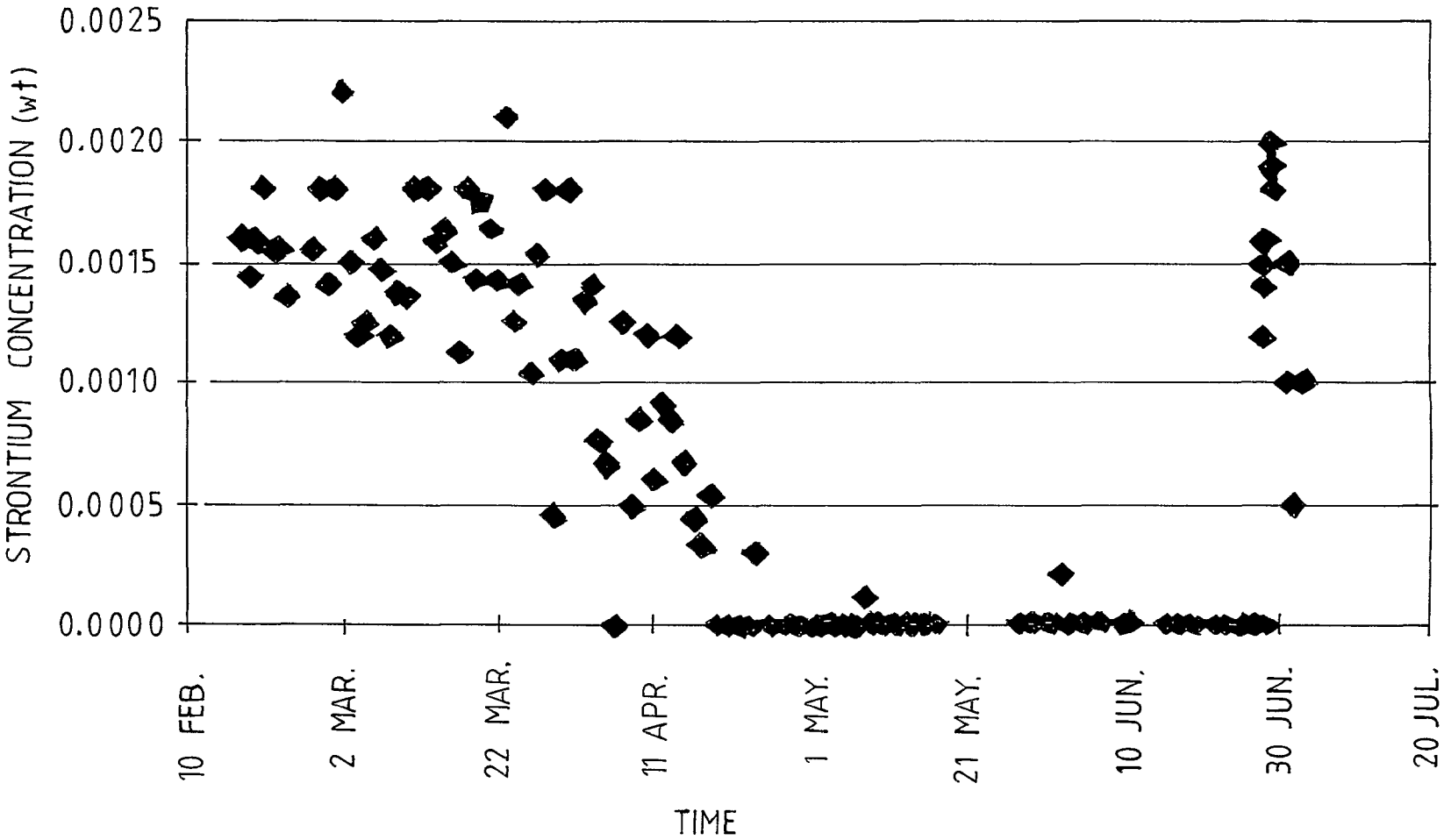
Figure 3:
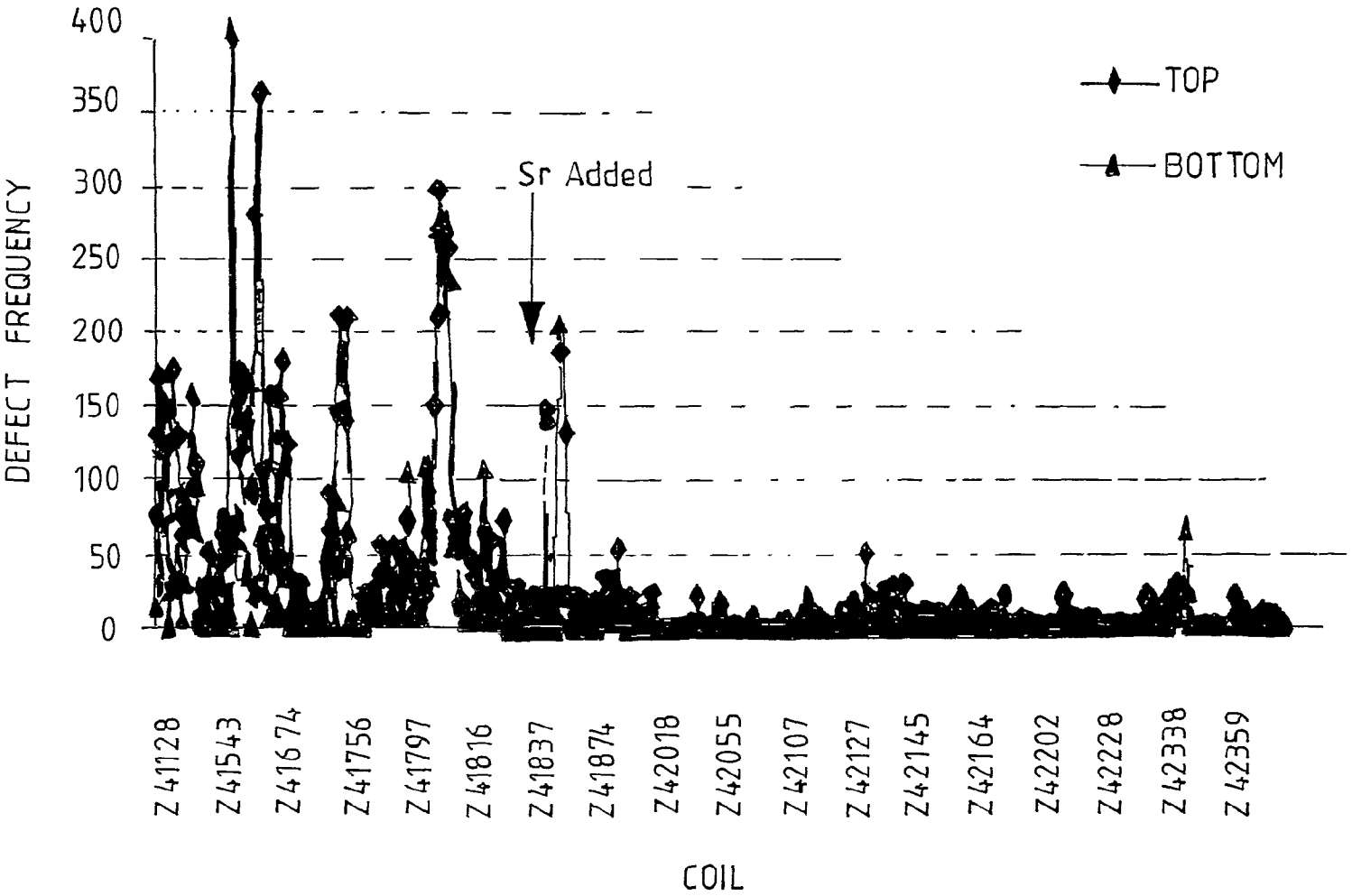

The present invention is described further by way of example with reference to the accompanying drawings of which:

FIG. 1 is a schematic drawing of one embodiment of a continuous production line for producing steel strip coated with aluminum-zinc-silicon alloy in accordance with the method of the present invention;

FIG. 2 a graph of the estimated concentration of strontium over a 5 month time period in a molten bath containing an aluminum-zinc-silicon alloy that forms part of a steel strip coating line of the applicant at a plant of the applicant at Westernport, Victoria, Australia; and FIG. 3 is a graph of the frequency of the above-described surface defects in the aluminum-zinc silicon alloy coatings formed by hot dip coating steel strip through the molten bath during part of the time period covered by the FIG. 2 graph.

DETAILED DESCRIPTION

The invention is based on the results of work carried out by the applicant that established that strontium and calcium, separately and in combination, substantially reduce the number of the above-described surface defects that form on steel strip that is hot dip coated in a molten bath of aluminum-zinc-silicon alloy.

The applicant has observed that "rough coating" and "pinhole-uncoated" surface defects are always associated with small areas where the metal coating has not alloyed with the steel strip.

While not wishing to be bound by the following comments, the applicant believes that oxides on the surface of the strip may be one factor that causes the absence of alloying of the aluminum-zinc-silicon alloy coating and the steel strip in the small areas. The applicant also believes that one major source of the oxides is the surface of the molten bath. The surface oxides are solid oxides that are formed from metals in the molten bath as a result of reactions between molten bath metal and water vapor in the snout above the molten bath. In a molten bath of an aluminum-zinc-silicon alloy, in addition to aluminum, zinc, and silicon, the molten bath contains minor amounts of other metals including magnesium. The applicant believes that surface oxides are taken up by strip as the strip passes through the oxide layer in order to enter the molten bath. The applicant has established that strontium and calcium minimize the amount of oxides that form on the bath surface and suspects that these elements may reduce the amount of oxides that are available to be taken up by the strip. The applicant also suspects that, alternatively or in combination, strontium and calcium may modify the properties of the surface oxides and, for example, increase the strength of the oxides whereby there is less likelihood that oxides will break away from the bath surface and be taken up by strip.

The present invention is particularly advantageous for "minimum spangle" strip.

The term "minimum spangle" strip is understood herein to mean metal coated strip that has spangles that are less than 0.5 m, preferably less than 0.2 mm, in the major dimension of the spangles substantially across the surface of the strip.

By way of example, the above-mentioned dimensions are measured using the average intercept distance method as described in Australian Standard AS1733, Standard spangled strip obscures the surface defects. Minimum spangle strip does not obscure the surface defects.

Minimum spangle strip may be formed by any suitable method steps, such as described in International application PCT/US00/23164 (WO 01/27343) in the name of Bethlehem Steel Corporation. The disclosure in the specification of the International application is incorporated herein by cross-reference.

With reference to FIG. 1, in use, coils of cold rolled steel strip are uncoiled at an uncoiling station 1 and successive uncoiled lengths of strip are welded end to end by a welder 2 and form a continuous length of strip.

The strip is then passed successively through an accumulator 3, a strip cleaning section 4 and a furnace assembly 5. The furnace assembly 5 includes a preheater, a preheat reducing furnace, and a reducing furnace.

The strip is heat treated in the furnace assembly 5 by careful control of process variables including: (i) the temperature profile in the furnaces, (ii) the reducing gas concentration in the furnaces, (iii) the gas flow rate through the furnaces, and (iv) strip residence time in the furnaces (i.e., line speed).

The process variables in the furnace assembly 5 are controlled so that there is removal of iron oxide residues from the surface of the strip and removal of residual oils and iron fines from the surface of the strip.

The heat treated strip is then passed via an outlet snout downwardly into and through a molten bath containing an aluminum-zinc-silicon alloy held in a coating pot 6 and is coated with aluminum-zinc-silicon alloy. Preferably the aluminum-zinc-silicon alloy contains the elements strontium and/or calcium. Preferably, the aluminum-zinc-silicon alloy does not contain the elements vanadium and/or chromium. The aluminum-zinc-silicon alloy is maintained molten in the coating pot by use of heating inductors (not shown). Within the bath, the strip passes around a sink roll and is taken upwardly out of the bath. Both surfaces of the strip are coated with the aluminum-zinc-silicon alloy as it passes through the bath.

After leaving the coating bath 6, the strip passes vertically through a gas wiping station (not shown) at which its coated surfaces are subjected to jets of wiping gas to control the thickness of the coating.

The coated strip is than passed through a cooling section 7 and subjected to forced cooling.

The cooled, coated strip, which typically is minimum spangle strip, is then passed through a rolling section 8 that conditions the surface of the coated strip.

The coated strip is thereafter coiled at a coiling station 10.

The above-described method is characterized by controlling the concentration of (i) strontium or (ii) calcium or (iii) strontium and calcium in the aluminum zinc-silicon alloy in the bath to be at least 2 ppm, more preferably at least 3 ppm, and preferably less than 150 ppm and more preferably less than 50 ppm.

As is indicated above, the applicant established the importance of strontium and calcium in the course of work carried out by the applicant.

The work was carried out as part of an investigation by the applicant to identify the cause of an unexpected substantial increase in the number of the above-described defects during a production phase on the aluminum-zinc-silicon alloy coating lines at the Westernport plant of the applicant. The coating lines were producing steel strip having a standard spangle coating.

The investigation was wide ranging and extensive and considered a significant number of possible causes of the surface defects before any consideration was given to the bath composition being the cause of the surface defects.

Unexpectedly, the applicant identified an absence of strontium in the molten baths in the coating lines as the cause of the sudden increase in the number of surface defects on the steel strip.

The applicant found that the onset of the substantial increase in the surface defects corresponded well with a change in the composition of the molten baths in the coating lines. The company supplying the aluminum ingots used as feed material to make the molten aluminum zinc-silicon alloy for the baths had made a change to the manufacturing process for the aluminum ingots. Prior to the change, the aluminum supplied by the company included small amounts of strontium as a contaminant that resulted in bath concentrations of strontium estimated to be in the range of 10-18 ppm. The change removed strontium altogether from the aluminum.

With reference to FIG. 2, the change in the aluminum ingot feed for the molten metal for one of the lines occurred around 18 Apr. 1995. This aluminum ingot feed was maintained until early July. The applicant found that there was a substantial increase in the number of surface defects in metal coated coils produced after 18 April. In order to establish the impact of bath strontium on the numbers of surface defects, the applicant decided to re-introduce strontium to the molten bath via the addition of aluminum-10% strontium "piglets". The piglets were added to the molten bath in early July. The strontium had a dramatic impact on the number of surface defects. With reference to FIG. 3, the arrow marked "Sr Added" indicates the dividing line between coated steel coils produced prior and after the addition of the piglets. It is evident from FIG. 3 that there was a substantially lower number of surface defects in the coated coils produced after the addition of the piglets. Further work carried out by the applicant indicates that the bath concentration of strontium should be controlled to be at least 2 ppm and more preferably at least 3 ppm.

Many modifications may be made to the preferred embodiment described above without departing from the spirit and scope of the present invention.

Having described the invention, what is claimed is:

1. A method of controlling surface defects in a coating on a steel strip comprising the steps of:

heat treating a steel strip in a heat treatment furnace;

forming a molten bath of a coating alloy for coating the steel strip, the coating alloy being an aluminum-zinc-silicon-magnesium alloy having 50% to 60% aluminum, 37% to 46% zinc, and 1.2% to 2.3% silicon, and a controlled concentration of (i) strontium, or (ii) strontium and calcium of greater than 10 ppm and not more than 150 ppm, where strontium is at least 2 ppm; and hot-dip coating the steel strip in the molten bath to form a coating alloy on the steel strip containing a concentration of (i) strontium or (ii) strontium and calcium resulting from the controlled concentration in the molten bath, wherein spangles on the coating alloy are less than 0.5 mm in a major dimension of the spangles across a surface of the steel strip.

2. The method of claim 1 where the molten bath has a magnesium concentration of less than 1%.

3. The method of claim 1 where the controlled concentration of (i) strontium, or (ii) strontium and calcium in the molten bath is not more than 50 ppm.

4. The method of claim 1 where the aluminum-zinc-silicon alloy does not contain the elements vanadium and/or chromium as deliberate alloy elements.

5. The method of claim 1, wherein the spangles on the coating alloy are less than 0.2 mm.

* * * * *